United States Patent [19]

Berger et al.

[11] 4,352,459

[45] Oct. 5, 1982

[54] ULTRASONIC LIQUID ATOMIZER HAVING AN AXIALLY-EXTENDING LIQUID FEED PASSAGE

[75] Inventors: Harvey L. Berger, Poughkeepsie; Charles R. Brandow, Highland, both of N.Y.

[73] Assignee: Sono-Tek Corporation, Poughkeepsie, N.Y.

[21] Appl. No.: 95,971

[22] Filed: Dec. 3, 1979

Related U.S. Application Data

[63] Continuation-in-part of Ser. No. 93,115, Nov. 13, 1979, abandoned.

[51] Int. Cl.[3] ..... B05B 17/06

[52] U.S. Cl. ..... 239/102; 310/325

[58] Field of Search ..... 310/323, 325; 128/200.16; 431/1; 261/DIG. 48; 239/4, 102; 123/472

[56] References Cited

U.S. PATENT DOCUMENTS

| | | | |
|---|---|---|---|
| 2,453,595 | 11/1948 | Rosenthal | 123/119 |
| 2,481,620 | 9/1949 | Rosenthal | 158/77 |
| 2,908,443 | 10/1959 | Fruengel | 239/102 |
| 2,930,912 | 3/1960 | Miller | 310/26 |
| 2,949,900 | 8/1960 | Bodine | 123/32 |
| 3,066,232 | 11/1962 | Branson | 310/8.7 |
| 3,101,419 | 8/1963 | Rich | 310/8.3 |
| 3,103,310 | 9/1963 | Lang | 239/4 |
| 3,121,534 | 2/1964 | Wilson | 239/4 X |
| 3,155,141 | 11/1964 | Doyle et al. | 158/28 |
| 3,162,368 | 12/1964 | Choate et al. | 239/102 |
| 3,200,873 | 8/1965 | O'Connor Young et al. | 158/57 |
| 3,214,101 | 10/1965 | Perron | 239/102 |
| 3,255,804 | 6/1966 | Lang | 158/76 |
| 3,275,059 | 9/1966 | McCullough | 239/4 X |
| 3,283,182 | 11/1966 | Jones et al. | 310/8.7 |
| 3,328,610 | 6/1967 | Jacke et al. | 310/8.3 |
| 3,368,085 | 2/1968 | McMaster et al. | 310/8.3 |
| 3,368,086 | 2/1968 | Libby | 310/9.2 |
| 3,373,752 | 3/1968 | Inoue | 134/1 |
| 3,394,274 | 7/1968 | Jacke et al. | 310/8.1 |
| 3,396,285 | 8/1968 | Minchenki | 310/8.7 |
| 3,400,892 | 9/1968 | Ensminger | 239/102 |
| 3,555,297 | 1/1971 | Pierson | 310/8.9 |
| 3,578,996 | 5/1971 | Balamuth | 310/8.7 |
| 3,689,783 | 9/1972 | Williams | 310/8.3 |
| 3,694,675 | 9/1972 | Loveday | 310/8.9 |
| 3,769,532 | 10/1973 | Tocquet et al. | 310/8.9 |
| 3,772,538 | 11/1973 | Supitilov | 310/9.1 |
| 3,790,079 | 2/1974 | Berglund et al. | 239/3 |
| 3,808,056 | 4/1974 | Pitcher et al. | 136/208 |
| 3,861,852 | 1/1975 | Berger | 431/1 |
| 3,885,172 | 5/1975 | Miller | 310/8.7 |
| 3,924,335 | 12/1975 | Balamuth et al. | 32/58 |
| 3,932,109 | 1/1976 | Pitcher et al. | 431/1 |
| 4,013,223 | 3/1977 | Martin | 239/102 |
| 4,019,683 | 4/1977 | Asai et al. | 239/102 |
| 4,034,244 | 7/1977 | Asai et al. | 310/8.2 |
| 4,121,549 | 10/1978 | Martin et al. | 123/32 |
| 4,153,201 | 5/1979 | Berger et al. | 239/102 |
| 4,169,984 | 10/1979 | Parisi | 310/325 X |
| 4,173,725 | 11/1979 | Asai et al. | 310/325 |
| 4,176,634 | 12/1979 | Martin | 123/119 |

FOREIGN PATENT DOCUMENTS

| | | | |
|---|---|---|---|
| 2032433 | 1/1972 | Fed. Rep. of Germany . | |
| 2430415 | 1/1976 | Fed. Rep. of Germany . | |
| 2734818 | 2/1978 | Fed. Rep. of Germany . | |
| 2743863 | 3/1978 | Fed. Rep. of Germany . | |
| 2208505 | 6/1974 | France . | |
| 53-143019 | 12/1978 | Japan . | |
| 53-143020 | 12/1978 | Japan . | |
| 55-15656 | 2/1980 | Japan . | |
| 807080 | 1/1959 | United Kingdom | 239/102 |
| 951537 | 3/1964 | United Kingdom . | |
| 999266 | 7/1965 | United Kingdom . | |
| 1102472 | 2/1968 | United Kingdom . | |
| 1111612 | 5/1968 | United Kingdom . | |
| 435859 | 7/1974 | U.S.S.R. | 310/325 |

OTHER PUBLICATIONS

IBM Technical Disclosure Bulletin, vol. 12, No. 3, Aug. 1969, M. Jakubowski.

"Ultrasonic Atomizer Incorporating a Self-Acting Liquid Supply", E. G. Lierke, Ultrasonics, Oct. 1967, pp. 214–218.

*Primary Examiner*—Andres Kashnikow

*Attorney, Agent, or Firm*—Kenyon & Kenyon

[57] ABSTRACT

An ultrasonic liquid atomizer is disclosed in which the liquid feed to the atomizing surface extends axially through the atomizer. This arrangement enables improved and simplified coupling of the liquid supply tube to the atomizer. In a disclosed embodiment, rear and front horn sections sandwich a driver, and an atomizing section is coupled to the front horn section. A passage axially extends through the rear section, the driver, the front section and the atomizing section to an atomizing surface. The driver includes piezoelectric elements of annular configuration. A tubular member or a liquid supply tube itself is received in the passage. In a preferred embodiment, the tubular member of the liquid supply tube includes a decoupling sleeve section and a stepped portion adapted to engage a stepped portion in the rear section upon coupling the tubular member or liquid supply tube to the atomizer to draw the front and rear sections together.

109 Claims, 7 Drawing Figures

PRIOR ART

ULTRASONIC LIQUID ATOMIZER HAVING AN AXIALLY-EXTENDING LIQUID FEED PASSAGE

This application is a continuation-in-part of application Ser. No. 93,115 filed on Nov. 13, 1979, now abandoned.

BACKGROUND OF THE INVENTION

This invention relates to ultrasonic transducer assemblies, particularly to ultrasonic liquid atomizers.

Liquid atomizers such as the atomizer disclosed in U.S. Pat. No. 4,153,201 of H. L. Berger and C. R. Brandow, which issued on May 8, 1979 and is assigned to the assignee of this application, include a radially extending passage in the atomizer section through which liquid is introduced into the atomizer. Typically however, the liquid supply tube and the atomizer are axially disposed with respect to each other, and in order to connect the atomizer to the liquid supply tube, a connecting tube and nipples, for example, are used to couple the radially-extending passage and the liquid supply tube. If properly installed, the connecting tube and nipples may provide a satisfactory connection of the atomizer to the liquid supply tube. However, the respective connections between the nipples, the connecting tube, the passage in the atomizer section and the liquid supply tube are prone to leaking. Additionally, making all the connections and insuring that they are leak-proof are time-consuming and burdensome.

When used as a fuel atomizer in a home fuel burner, for example, an atomizer of the type described above can be supported by the blast tube. For example, the atomizer described in the above U.S. Pat. No. 4,153,201 patent is bolted to the blast tube. An annular flange having spiders affixed thereto is connected to the atomizer and the bolts connect the flange to the blast tube as spaced by the spiders. While the atomizer is securely supported in this manner, several pieces of hardware are required and installation is time consuming.

OBJECTS AND SUMMARY OF THE INVENTION

It is an object of the present invention to provide an improved ultrasonic liquid atomizer.

It is also an object of the present invention to improve liquid delivery to an ultrasonic liquid atomizer.

It is another object of the present invention to improve liquid delivery in an ultrasonic liquid atomizer to the atomizing surface.

It is yet another object of the present invention to provide for improved coupling of a liquid supply tube to an ultrasonic liquid atomizer.

It is a further object of the present invention to provide for improved mounting of an ultrasonic liquid atomizer.

It is another object of the present invention to utilize the liquid supply tube to support an ultrasonic liquid atomizer.

It is still another object of the present invention to provide improved apparatus for eliminating premature atomization of liquid in the liquid passage leading to the atomizing surface of an ultrasonic liquid atomizer.

It is also an object of the present invention to provide improved driving means for an ultrasonic atomizer.

It is a further object of the present invention to provide for improved mounting of the driving means in an ultrasonic atomizer.

In accordance with the present invention, liquid to be atomized is introduced into the liquid atomizer axially and is supplied to the atomizing surface through an axially-extending passage. Thereby, the invention eliminates the need to provide a radially-extending connection to the atomizer for the supply of liquid. Further in accordance with the invention, a reduced number of connections is required to couple the liquid supply tube to the atomizer, and a simplified manner of making the connection and a simplified atomizer construction result.

Typically, the liquid supply tube and the atomizer are axially disposed with respect to each other. In such a case, in accordance with the invention, the liquid supply tube may be connected to the atomizer by a single connection.

According to one aspect of the invention, the passage comprises a tubular member which extends within at least part of the passage, and means are provided for receiving the tubular member.

In accordance with another aspect of the invention, the tubular member is constituted by the liquid supply tube which extends into the axially-extending passage and supports the atomizer.

The tubular member may include means for connecting the tubular member to a means for supplying liquid, or the tubular member may, as mentioned, form part of a liquid supply tube.

According to another aspect of the invention, means are provided which cooperate with the tubular member or the liquid supply tube for improved coupling of the tubular member of liquid supply tube to the atomizer and/or improved coupling of atomizer sections and the atomizer driving means. Such means enhance performance of the atomizer.

Preferably, the tubular member (liquid supply tube) is threaded and a threaded section is provided in the atomizer to receive the threaded tubular member. The tubular member or liquid supply tube is thus preferably connected to the atomizer by a threaded joint. A means such as a sealing compound is applied to the threaded joint to prevent fuel from escaping to the driving means. In a preferred embodiment, the threads in the atomizer for receiving the tubular member commence at the start of the output section or a small distance within said output section and extend in the output section towards the atomizing surface.

In a preferred embodiment, the tubular member forms part of the liquid supply tube which has a threaded section spaced from the end thereof and a decoupling sleeve connected at the end of the threaded section which extends to or adjacent to the atomizing surface.

According to a preferred embodiment of the invention in which coupling of the tubular member or liquid supply tube to the atomizer and/or coupling of atomizer front and rear sections and the atomized driving means is improved, the tubular member or liquid supply tube having a threaded end or a threaded section which is threadedly received in the atomizer front section includes means which cooperate with other means in or on the atomizer rear section adjacent the driving means, for drawing the rear and front sections together when the tubular member or liquid supply tube is threaded into the atomizer front section. This provides a symmetric attachment of the tubular member or liquid supply tube in which the effective attachment plane of the tubular member or liquid supply tube is at or close to the natural nodal plane of the actual attachment plane. Such means for drawing the sections together are disclosed to comprise an annular flange or step on the tubular member or liquid supply tube and a mating annular flange or step in the rear section, preferably adjacent to the driving means. Upon threading the tubular member or liquid supply tube to the atomizer front section, the annular flanges engage and draw the rear section against the driving means towards the atomizer front section.

In accordance with another aspect of the invention, a metal decoupling sleeve is provided to eliminate premature atomization of liquid in the liquid passage leading to the atomizing surface of an ultrasonic liquid atomizer.

In accordance with still another aspect of the invention, a metal tube extends in the axial passage from one end of the ultrasonic atomizer to the atomizing surface, a part of the tube constituting the decoupling sleeve. Thus, the tubular member described above and the decoupling sleeve are formed by a one-piece metal tube. Preferably, the one-piece metal tube is constituted by the liquid supply tube and includes the annular flange for engaging the annular flange in the atomizer rear section.

In accordance with yet another aspect of the invention, a transducer for atomizing liquids is provided which comprises an atomizing section having an atomizing surface, ultrasonic driving means disposed adjacent the atomizing section, the atomizing section and the driving means having a passage extending axially therethrough to the atomizing surface, and means for coupling the driving means and the atomizing section, to atomize liquid delivered to the atomizing surface through the axially-extending passage in response to electrical excitation of the driving means. The driving means may comprise one or more piezoelectric elements.

In accordance with another aspect of the invention, the transducer is of the type disclosed in the U.S. Pat. No. 4,153,201 and includes a front ultrasonic horn section, a rear ultrasonic horn section, a driving means having at least one piezoelectric disc sandwiched between the front and rear ultrasonic sections, means for clamping the front and rear ultrasonic horn sections against the driving element, and an output section extending from the front ultrasonic horn section and terminating in an atomizing surface. A passage is provided which axially extends through the front and rear sections and the driving element to the atomizing surface, the passage axially extending from the end of the rear section, through the driving element and front section to the end of the front section. The transducer assembly may include a symmetrical double-dummy ultrasonic horn having a driving element sandwiched therein.

In a preferred embodiment, the tubular member (liquid supply tube) extends through the driving means with the end of the tubular member being disposed in or adjacent to the atomizing section or the output section. The driving means includes an electrode and one or more driving elements, all of which have an opening through which the tubular member extends. Means are provided for insulating the elctrode and the driving elements from the tubular member. Preferably, the end of the tubular member is threadedly received in or adjacent to the atomizing section or output section.

In accordance with a further aspect of the invention, improved driving means are provided which comprise a pair of annular piezoelectric elements sandwiching an annular electrode. The diameter of the electrode is reduced thereby providing clearance beyond the periphery of the electrode for mounting fasteners such as rods or bolts which heretofore passed through the electrode. The bolts or rods extend between sections of the atomizer and couple the driving means in the atomizer. The clearance provided by the reduced diameter electrode eliminates the need to insulate the bolts from the electrode. In a preferred embodiment, the diameter of the piezoelectric elements is less than the diameter of the electrode and a ring or sleeve of insulating material is disposed about the elements adjacent the electrode, the outside diameter of the ring being approximately equal to the outside diameter of the electrode.

The annular piezoelectric elements are centered by means of the axial passage in accordance with another aspect of the invention, thereby eliminating the need to provide centering means such as circular recesses in the atomizer faces adjacent the elements.

The tubular member, which may be the liquid supply tube, and the decoupling sleeve, which may also constitute a part of the liquid supply tube may be made of mismatched acoustic materials with respect to the atomizer; however, the applicants have found that it is not necessary to use mismatched materials. For example, with an aluminum atomizer, aluminum accoustically mismatched materials such as copper, steel, etc., as well as aluminum may be used to fabricate the tubular member or liquid supply tube and the decoupling sleeve.

These and other aspects of the invention will be more apparent from the following description of the preferred embodiments when considered with the accompanying drawings.

BRIEF DESCRIPTION OF THE DRAWINGS

The present invention is illustrated by way of example and not limitation in the figures in the accompanying drawings in which like numerals indicate similar parts and in which.

DESCRIPTION OF THE PREFERRED EMBODIMENTS

Figure 1:
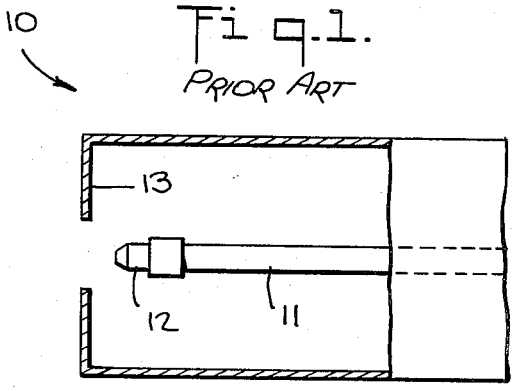
Fig. 1. PRIOR ART
FIG. 1 is a side view partly in section of a portion of the blast tube of a conventional pressure-atomizing fuel burner.

Conventional pressure-type atomizing fuel burners include a blast tube to which fuel is delivered and from which the atomized fuel-air mixture is discharged. Such conventional burners have a concentric fuel line geometry, as illustrated in FIG. 1. For clarity, only the blast tube housing 10, the fuel tube 11 and the atomizing nozzle 12 are shown. Typically, the fuel line in a conventional home burner includes a $\frac{3}{8}$ inch diameter steel fuel tube 11 which enters the blast tube housing 10 at the rear and extends along the central axis of the blast tube housing terminating with the pressure nozzle 12 at or adjacent to a swirl plate 13 at the front of the blast tube housing.

Figure 2:
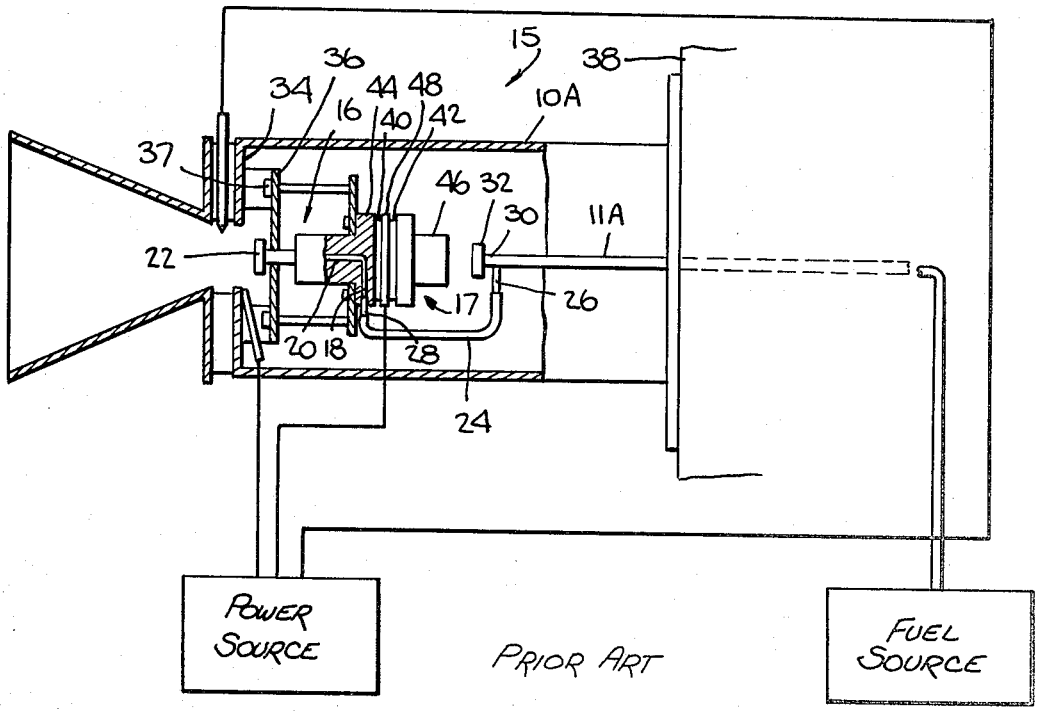
FIG. 2 is a side view partly in cross section and partly in schematic of an ultrasonic fuel burner constructed in accordance with U.S. Pat. No. 4,153,201.

In ultrasonic fuel burners such as the fuel burner 15 illustrated in FIG. 2, which may be of the type described in U.S. Pat. No. 4,153,201, the disclosure of which is incorporated by reference, fuel oil is introduced into the atomizing section 16 of atomizer 17 through a radially-extending passage 18. The radially extending passage 18 communicates with an axially-extending passage 20 which terminates in the atomizing surface 22. In order to connect the atomizer 17 to an existing fuel tube such as 11 of FIG. 1 or a similar fuel tube 11A of FIG. 2, a connecting hose 24 and fuel nipples 26, 28 can be utilized. To make the connection, the fuel tube 11A in FIG. 2 is blocked at its leading end 30 with a plate or cap 32, or other suitable means. The plate or cap 32 may be secured by a threaded connection or by means of an adhesive. A hole is drilled in the tube 11A adjacent end 30 and the nipple 26 is installed. The nipple 28 is installed in the radially extending passage 18. The connecting tube 24, which may be a flexible plastic hose, is connected to the two nipples to complete connection of the fuel line to the atomizer. The nipples are typically connected to the atomizer and the fuel tube by means of threaded connections, and the hose 24 is force fitted over the nipples. The hose may be clamped over the nipples, if desired.

The ultrasonic atomizer 17 is itself bolted to the front end 34 of the blast tube by means of an annular mounting plate 36 having spiders 37 incorporated therein to space the plate 34 and atomizer from the front 34 of the blast tube. The blast tube housing 10A in turn is typically secured to the fuel burner in a conventional manner.

The manner of connecting the fuel tube 11A to the ultrasonic atomizer 17 as shown in FIG. 2 has several drawbacks. For example, each connection between the fuel tube 11A and the radially extending passage 18 is susceptible to leaking. Thus, the nipple 26/fuel tube 11A connection, the hose 24/nipple 26 connection, the hose 24/nipple 28 connection, and the nipple 28/radial passage 18 connection are all potential sources of leaks. Moreover, the ultrasonic atomizer must be secured to the blast tube housing which requires mounting hardware such as the annular plate, the spiders and the bolts.

The burner shown in FIG. 2 includes generally solid driving elements 40, 42 sandwiched between front and rear horn sections 44 and 46 as described in U.S. Pat. No. 4,153,201. Interposed between the driving elements 40, 42 is an electrode 48. The driving elements 40, 42 and the electrode 48 are of disc configuration and the sections 44, 46, the driving elements 40, 42 and the electrode 48 are held together by bolts extending through the driving elements and the electrodes, means being provided to insulate the bolts from the electrode.

In accordance with the present invention, the fuel tube itself (FIGS. 3, 4 and 7) or a tube connected to the fuel tube (FIG. 5) is axially received in the atomizer and extends axially through the rear section, the driving elements and the electrode to the front section.

Figure 3:
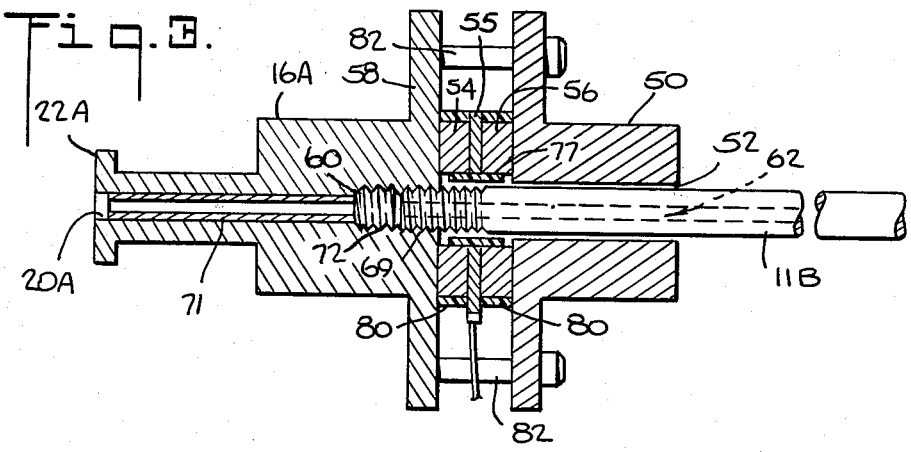
FIG. 3 is an axial section view of an atomizer for an ultrasonic fuel burner constructed in accordance with the present invention and in which the fuel tube is received in the atomizer.
Figure 4:
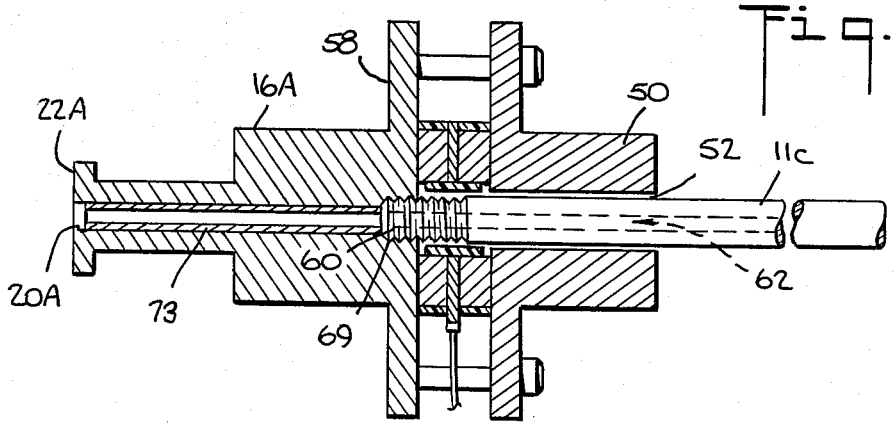
FIG. 4 is an axial section view similar to that of FIG. 3 in which the fuel tube includes a reduced diameter section which serves as a decoupling sleeve, the fuel tube being received in the atomizer.
Figure 5:
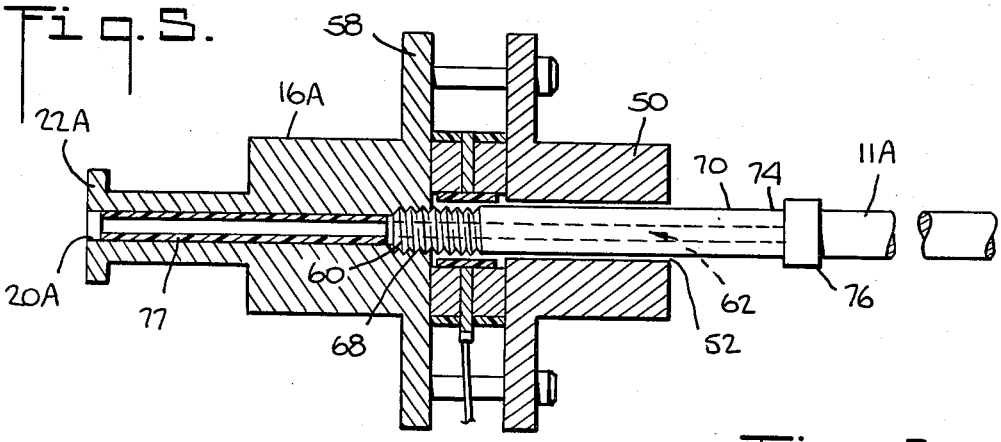
FIG. 5 is an axial section view of an atomizer similar to that of FIG. 3 in which one end of a tubular member is received in the atomizer and the other end is connected to the fuel tube.

In FIGS. 3–5 and 7, the rear section 50 is provided with an axially-extending bore or passage 52. The driving elements 54, 56 and the electrode 55 are of annular configuration, i.e., they are washer-like having a central opening or passage therethrough. Piezoelectric annular driving elements are available from Venitron Corporation of Cleveland, Ohio. The forward section 58 is provided with an axially extending, threaded bore or passage 60 which communicates with the axially extending passage 20A to the atomizing surface 22A in the atomizing section 16A. The axial passages in the rear, front and atomizer sections and the openings in the driving elements and the electrode are axially disposed to form a fuel passage referenced generally by 62 and extending axially from the exterior of the rear section to the atomizing surface. The relative diameters of the individual passages and openings which form the overall, axially-extending passage 62 for FIGS. 3–5 illustrated in FIG. 6.

In the atomizers of FIGS. 3–5, the rear section 50 includes a central bore 52 of diameter a; the central openings 64, 66 of the driving elements are of diameter b adjacent the ends 56A, 54A of the driving elements, and of diameter a therebetween; the central opening 65 in the electrode 55 is of diameter b; and the front section includes a threaded bore 60 of diameter c located adjacent to the driving elements and which is in communication with the central bore 20A of diameter d, in atomizer section 16A. The threaded section 60 receives the threaded end 68 of a connecting tube 70 (FIG. 5), or the end 69 of the fuel tube itself (FIGS. 3 and 4). The fuel tube 11B (FIG. 3) or the connecting tube 70 (FIG. 5) extends through the passage 52 in the rear section 50, through the openings 64–66 in the driving elements and electrode, and into the forward section 58. The end 68 of the tube 70 or the fuel tube end 69 is threadedly connected in the threaded section 60 and a sealing or joint compound is applied to the joint to insure that there is no leakage.

Referring to FIG. 3, the fuel tube 11B has a threaded end 69 which is received in the threaded section 60 in the front section 58. A decoupling sleeve 71 of Teflon or, according to the invention and as illustrated in FIG. 3, of other suitable material such as aluminum, steel, copper, etc., is disposed in bore 20A and extends to just short of the opening in surface 22A. The decoupling sleeve 71 includes a threaded end section 72 which is threaded onto the threaded section 60 in the atomizer forward section 58.

Referring to FIG. 4, the fuel tube 11C includes a reduced diameter section 73 extending from the threaded section 69A. The reduced diameter section 73 is the decoupling sleeve and is made of the same material as the fuel tube 11C. Providing the decoupling sleeve as part of the fuel tube 11C yields a leak-proof passage throughout the atomizer. When used in place of a Teflon decoupling sleeve, the metal fuel tube decoupling sleeve eliminates the use of a plastic part in the vicinity of potentially high temperatures. Production is also simplified by the use of a single piece. The diameter of the decoupling sleeve portion of the tube is such that it makes light contact with the fuel passage 20A incorporated in the front section 58. This avoids a force fit which may otherwise cause deleterious pressures to be exerted resulting in performance degradation and also avoids the possibility of acoustic coupling between the tube and the front section which may result from a tight fit.

As shown in FIG. 5, a tubular member 70 may be threaded in the atomizer and the end 74 of the tubular member is secured to the fuel tube 11A. For example, the tubular member 70 is connected to the fuel tube 11A by a bushing or union coupling 76. The atomizer in FIG. 5 utilizes a conventional Teflon decoupling sleeve 77.

Figure 7:
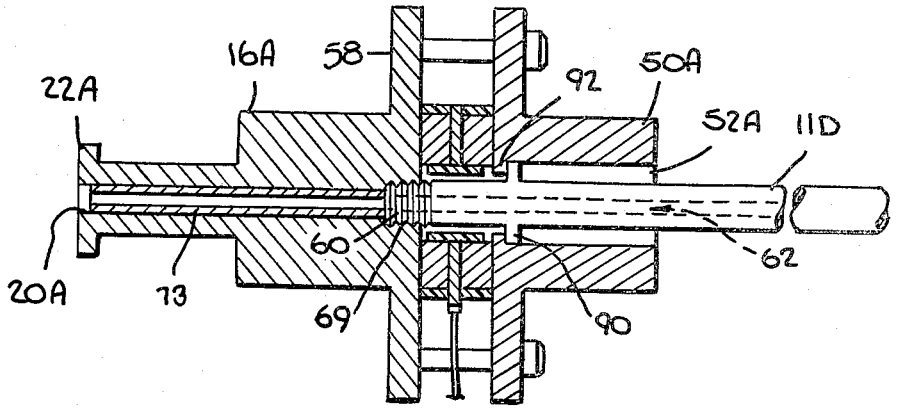
FIG. 7 is an axial section view of an atomizer similar to that of FIG. 4 in which the tubular member includes an annular flange and the atomizer rear section also includes an annular flange which engage upon threading the tubular member to the atomizer.

Referring now to FIG. 7, an atomizer similar to the one of FIG. 4 is illustrated in which the fuel tube 11D is provided with an annular flange or step 90 spaced from the threaded portion 69, and the rear section 50A is also provided with an annular flange or step 92 disposed adjacent to the driving means. Flanges 90 and 92 engage upon threading the fuel tube 11D onto threaded section 60 with the rear and forward sections 58 and 50A being drawn together sandwiching the driving means. The diameter of the bore 52A in the rear section 50A adjacent the flange 92 is "e" and the diameter of the bore at the flanges is "a". This arrangement causes the attachment forces to be approximately equal on the front and rear sections of the atomizer. It is believed that the effective attachment plane of the fuel tube in the atomizer lies midway between the front and rear sections, or approximately at the nodal plane. An advantage of this arrangement is that the fuel tube provides a means of securing both sections of the atomizer prior to applying torque to bolts 82. Another advantage of this arrangement is a reduction in vibration on the fuel tube extending beyond the rear section, there being little or no vibration on the fuel extending beyond the rear section. A further advantage of this arrangement is to reduce the sensitivity of atomizer performance to the fuel tube length, degree of tightening of a fuel tube or tubular member not having means engaging both the front and rear atomizer sections, and the manner of coupling of a tubular member to an external fuel tube. Such factors may otherwise change the reasonant frequency of the fuel tube and the atomizer and may result in an increase in atomizer impedance and a reduced value of Q. This may manifest itself as an effective shortening of the atomizer.

The applicants have found that while accoustically mismatched materials can be used for the fuel tube or tubular member and the decoupling sleeve (e.g. copper, steel, etc., fuel tube, tubular member or sleeve for aluminum atomizer sections), such is not necessary. Accordingly, an aluminum fuel tube and decoupling sleeve may be utilized with aluminum rear and front atomizing sections.

Figure 6:
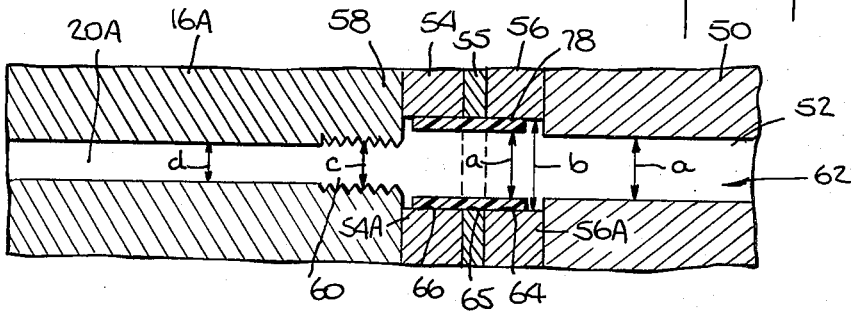
FIG. 6 is an enlarged diagram, broken away, of the atomizer of FIGS. 3-5 illustrating the fuel passage extending through said atomizers and illustrating the diameter of the passage at different locations in the atomizer.

The center electrode is electrically isolated from the fuel tube 11B, 11C, 11D or the connecting tube 70 by means of a nylon or other electrical insulating medium tube 78 which is disposed about the fuel or connecting tube at a point which lies within the electrode opening 65. The insulator also extends in the openings 64, 66 of the driving elements and shields the fuel or connecting tube from the inner surfaces, which may have received some plating, of the driving elements adjacent to the electrode. The nylon or other electrical insulating medium tube 78 extends in the sections of reduced diameter "a" between the sections of increased diameter "b" (FIG. 6). Rubber or other composition rings or gaskets 80 are disposed about the outer periphery of the driving elements 54, 56 adjacent the periphery of the electrode 55. The driving elements 54, 56 and the electrode 55 are of reduced outer diameter, thereby providing clearance for bolts 82 which couple the driving elements in the atomizer with the front section 58 and the rear section 50. As a result, the need to provide holes through the electrode and driving elements and to insulate the bolts from the electrode are obviated.

Annular recesses in the inner faces of the front and rear sections are eliminated. These recesses were used to center the piezoelectric crystal discs. However, centering according to the invention is provided by the axial openings in the piezoelectric crystals and the electrode.

The applicants have found that no degradation in performance results from the axial openings in the piezoelectric crystals, one reason being that the entire atomizer has a central axial void.

Thus as shown in FIGS. 3–7, fuel is delivered to the atomizing surface axially in the atomizer.

Providing an axial passage in the atomizer, as shown in FIGS. 3–7, permits the fuel tube to support the atomizer, directly as in FIGS. 3, 4 and 7, or indirectly through the tubular member 70 as in FIG. 5. This eliminates the need for the mounting hardware shown in FIG. 2 and the corresponding installation time.

A tube such as tube 70 or the fuel tube 11B, 11C, 11D may be connected to the atomizer in ways other than described above in connection with FIGS. 3–7. For example, adhesives may be used to secure the tube, and the tube may be connected at different locations in the atomizer. Additionally the atomizer can be supplied with a tube such as tube 70 permanently secured in the atomizer.

The fuel burner of FIGS. 3–7 may otherwise operate as described in U.S. Pat. No. 4,153,201.

It should be obvious to those skilled in the art that while this invention has been illustrated for use in a fuel burner, more specifically a fuel burner for heating, it may be used elsewhere to great advantage. The invention may also be used for feeding fuel into internal combustion or jet engines and for atomization of liquids other than fuel, such as water and paint.

While the invention has been particularly shown and described with reference to the preferred embodiments thereof, it will be understood by those skilled in the art that various changes in form and detail and omission may be made without departing from the spirit and scope of the invention. For example, the fuel tube may be communicated with the atomizing nozzle axially in the atomizer by specific arrangements other than those illustrated and described in the application.

What is claimed is:

1. In an ultrasonic transducer assembly for atomizing a liquid including a front ultrasonic horn section, a rear ultrasonic horn section, a driving means having at least on piezoelectric element and an electrode sandwiched between the front and rear sections, means for clamping the front and rear sections against the driving means, and an output section extending from the front section and terminating in an atomizing surface, wherein the improvement comprises a liquid passage axially extending through the front and rear sections and the driving means to the atomizing surface, the diameter of the driving means being less than the diameter of the front and rear sections adjacent the driving means, the means for clamping the front and rear sections comprising a plurality of fasteners connecting the front and rear sections and extending therebetween beyond the diameter of the driving means, and a tubular sleeve extending about each of the piezoelectric elements.

2. In an ultrasonic transducer assembly for atomizing a liquid including a front ultrasonic horn section, a rear ultrasonic horn section, a driving means having at least one piezoelectric element and an electrode sandwiched between the front and rear ultrasonic horn sections, means for clamping the front and rear ultrasonic horn sections against the driving means, and an output section extending from the front ultrasonic horn section and terminating in an atomizing surface, wherein the improvement comprises a driving element of a diameter less than the diameter of the front and rear sections adjacent the driving means, and wherein the means for clamping comprises a plurality of fasteners connecting the front and rear sections and extending therebetween beyond the diameter of the driving means, the driving means comprising two said piezoelectric elements which are of annular configuration, each including an opening therethrough which forms part of the axially-extending passage, the electrode having an opening therethrough which forms part of the axially extending passage and being interposed between the piezoelectric elements, and a tubular sleeve disposed extending about each of the piezoelectric elements.

3. The improvement according to claim 2, wherein the sleeves are of rubbery material.

4. The improvement according to claim 2, wherein the diameter of the piezoelectric elements is less than the diameter of the electrode and the outside diameter of the tubular sleeves is approximately equal to the diameter of the electrode.

5. The improvement according to claim 2, and including a liquid passage axially extending through the front and rear sections and the driving means to the atomizing surface.

6. In an ultrasonic transducer assembly for atomizing a liquid including a front ultrasonic horn section, a rear ultrasonic horn section, a driving means having at least one piezoelectric element and an electrode sandwiched between the front and rear sections, means for clamping the front and rear sections against the driving means, and an output section extending from the front section and terminating in an atomizing surface, wherein the improvement comprises a liquid passage axially extending through the front and rear sections and the driving means to the atomizing surface, the output and the front and rear sections being of metal material, the ultrasonic transducer including a metal decoupling sleeve extending in the axially-extending passage within the output section to or adjacent to the atomizing surface, and the decoupling sleeve including a threaded end section and the front section including a threaded section, the decoupling sleeve being threadedly received in the front section.

7. The improvement according to claim 6, wherein the axially-extending passage is adapted to receive a tubular member therein through which liquid is introduced into the passage.

8. The improvement according to claim 7, wherein the tubular member includes a threaded end section adjacent the decoupling sleeve which is threadedly received in the threaded section in the front section.

9. The improvement according to claim 8, wherein the decoupling sleeve and the tubular member constitute a single piece having threads which are threaded onto the threads of the front section.

10. The improvement according to claim 8 or 9, wherein means are provided associated with the rear section and the tubular member for drawing the rear and front sections together upon threading the tubular member to the front section.

11. The improvement according to claim 10, wherein said means for drawing comprise mating annular flange portions on the tubular member and in the axially-extending passage in the rear section.

12. The improvement according to claim 6 or 8, wherein the threaded section in the front section is disposed at or adjacent to a nodal plane.

13. The improvement according to claim 6, and including a tubular member disposed at least in part in the axially-extending passage for introducing liquid into the transducer for delivery to the decoupling sleeve.

14. A transducer for atomizing liquids comprising an atomizing section having an atomizing surface, driving means disposed adjacent the atomizing section, the atomizing section and the driving means having a passage axially extending therethrough to the atomizing surface, a decoupling sleeve extending in the axially-extending passage within the atomizing section to or adjacent to the atomizing surface, the decoupling sleeve including a threaded end section and the atomizing section including a threaded section, the decoupling sleeve being threadedly received in the atomizing section, and means for coupling the driving means and the atomizing section to atomize liquid delivered to the atomizing surface through the axially-extending passage and decoupling sleeve in response to electrical excitation of the driving means.

15. The transducer according to claim 14, wherein the decoupling sleeve is metal.

16. The transducer according to claim 14, wherein the axially-extending passage is adapted to receive a tubular member therein through which liquid is introduced into the transducer.

17. The transducer according to claim 14 and including a tubular member disposed in the axially-extending passage for introducing liquid into the transducer for delivery to the decoupling sleeve.

18. The transducer according to claim 16 or 17, wherein means are provided in or adjacent to the atomizing section for securing the tubular member to the atomizing section.

19. The transducer according to claim 18, wherein the securing means is disposed at or adjacent to a nodal plane.

20. The transducer according to claim 18, wherein the securing means and the tubular member include threads, the threaded securing means threadedly receiving the tubular member.

21. The transducer according to claim 18, wherein the decoupling sleeve and the tubular member constitute a single piece having threads which are threaded onto the threads of the securing means.

22. The transducer according to claim 14, wherein the atomizing section and the decoupling sleeve are of metal material.

23. In an ultrasonic fuel atomizer including driving means and an output section having an atomizing surface, the improvement comprising a fuel passage axially extending in the atomizer from one end thereof through the driving means to the atomizing surface and a fuel tube through which fuel is adapted to be supplied to the atomizer, the fuel tube extending in said passage and including a decoupling sleeve section extending within the output section to or adjacent to the atomizing surface, the fuel tube and decoupling sleeve section constituting a single piece, and means provided in or adjacent to the output section for securing the single piece to the output section.

24. The improvement according to claim 23, wherein selected sections of th atomizer including the output section are of metal and the single piece fuel tube and decoupling sleeve is of metal.

25. The improvement according to claim 24, wherein the selected sections including the output sections are of aluminum.

26. The improvement according to claim 25, wherein the single piece fuel tube and decoupling sleeve is of aluminum.

27. The improvement according to claim 23 or 24, wherein the single piece comprises a sole support for mounting the atomizer.

28. The improvement according to claim 23, wherein the securing means includes threads in the axially-extending passage in the output section and the single piece includes threads, the threaded securing means threadedly receiving the single piece.

29. The improvement according to claim 28, wherein the atomizer includes a rear section disposed adjacent to the driving means which with the output section sandwiches the driving means, the securing means being disposed in the output section, and including an annular flange portion on the single piece and a mating annular flange section in the axially-extending passage and the rear section, the flange sections engaging and drawing the rear and output sections together upon threading the single piece onto the securing means.

30. The improvement according to claim 23 or 28, wherein the securing means is disposed at or adjacent to a nodal plane.

31. The improvement according to claim 23 wherein the fuel tube includes means for connecting it to a fuel supply means.

32. In an ultrasonic fuel atomizer including an atomizing section having an atomizing surface, driving means disposed adjacent to the atomizing section and means for coupling the driving means to the atomizing section, the improvement comprising a fuel passage axially extending in the atomizer from one end thereof through the driving means to the atomizing surface, a decoupling sleeve in the axially-extending passage in the atomizing section with one end thereof extending substantially to the atomizing surface, the axially-extending passage being adapted to receive a tubular member through which liquid can be introduced into the transducer and delivered through the decoupling sleeve to the atomizing surface, and means provided in or adjacent to the atomizing section adapted to secure the tubular member to the atomizing section with one end of the tubular member adjacent to the other end of the decoupling sleeve, the securing means being spaced radially inwardly of the coupling means.

33. In an ultrasonic fuel atomizer including an atomizing section having an atomizing surface, driving means disposed adjacent to the atomizing section, a rear section disposed adjacent to the driving means which with the atomizing section sandwiches the driving means, and means for coupling the driving means to the atomizing section, the improvement comprising a fuel passage axially extending in the atomizer from one end thereof through the driving means and the rear means to the atomizing surface, a tubular member having a threaded portion disposed in the axially-extending passage through which liquid can be introduced into the transducer and delivered to the atomizing surface, means provided in or adjacent to the atomizing section for securing the tubular member to the atomizing section comprising threads in the axially-extending passage which receive the threaded portion of the tubular member, the securing means being spaced radially inwardly of the coupling means, and means associated with the rear section and the tubular member for drawing the rear and the atomizer sections together upon threading the tubular member to the atomizing section.

34. The improvement according to claim 32 and including the tubular member which is secured to the atomizing section.

35. The improvement according to claim 33 or 34, wherein the tubular member comprises a part of a fuel tube through which fuel is adapted to be supplied to the atomizer.

36. The improvement according to claim 33 and including a decoupling sleeve extending in the output section of the atomizer to or adjacent to the atomizing surface.

37. The improvement according to claim 32 or 36, wherein the decoupling sleeve is secured to the atomizing section by the securing means.

38. The improvement according to claim 36, wherein the decoupling sleeve includes a threaded section received in the threaded section in the axially-extending passage in the atomizing section.

39. The improvement according to claim 34 or 36, wherein the decoupling sleeve and the tubular member constitute a single metal piece.

40. The improvement according to claim 36, wherein the decoupling sleeve and the tubular member constitute a single piece and the threads of the tubular member are located on the tubular member adjacent to the decoupling sleeve.

41. The improvement according to claim 33 or 34, wherein the tubular means comprises a sole support for mounting the atomizer.

42. The improvement according to claim 34, wherein the transducer includes a rear section disposed adjacent to the driving means which with the atomizing section sandwiches the driving means, the axially-extending passage extending through the rear section, and means associated with the rear section and the single piece for drawing the rear and atomizing sections together upon securing the tubular member to the atomizing section.

43. The improvement according to claim 32 and including the tubular member which is secured to the atomizing section, wherein the tubular member includes threads and the securing means includes a threaded section in the axially-extending passage in the atomizing section, the threads of the tubular member being received by the threaded section of the securing means.

44. The improvement according to claim 32 or 33 wherein the securing means is disposed at or adjacent to a nodal plane.

45. The improvement according to claim 33, wherein the means for drawing comprise flanged portions on the tubular member and the rear section adapted to engage each other to draw the front and rear sections together upon threading the tubular member to the front section.

46. The improvement according to claim 45 wherein the securing means is disposed at or adjacent to a nodal plane.

47. In an ultrasonic transducer assembly for atomizing a liquid including a front ultrasonic horn section, a rear ultrasonic horn section, driving means having at least one piezoelectric element and an electrode sandwiched between the front and rear sections, means spaced radially outwardly of the axis of the transducer for clamping the front and rear sections against the driving means, and an output section extending from the front section and terminating in an atomizing surface, wherein the improvement comprises a liquid passage axially extending through the front and rear sections and the driving means to the atomizing surface, a decoupling sleeve in the axially-extending passage in the front section with one end thereof extending substantially to the atomizing surface, the axially-extending passage being adapted to receive a tubular member through which liquid can be introduced into the transducer and delivered through the decoupling sleeve to the atomizing surface, and means provided in or adjacent to the front section adapted to secure the tubular member to the front section with one end of the tubular member adjacent to the other end of the decoupling sleeve.

48. In an ultrasonic transducer assembly for atomizing a liquid including a front ultrasonic horn section, a rear ultrasonic horn section, driving means having at least one piezoelectric element and an electrode sandwiched between the front and rear sections, means spaced radially outwardly of the axis of the transducer for clamping the front and rear sections against the driving means, and an output section extending from the front section and terminating in an atomizing surface, wherein the improvement comprises a liquid passage axially extending through the front and rear sections and the driving means to the atomizing surface, a tubular member having a threaded portion disposed in the axially-extending passage through which liquid can be introduced into the transducer and delivered to the atomizing surface, means provided in or adjacent to the front section for securing the tubular member to the front section comprising threads in the axially extending passage which receive the threaded portion of the tubular member, and means associated with the rear section and the tubular member for drawing the rear and the front sections together upon threading the tubular member to the front section.

49. The improvement according to claim 47 or 48, wherein the at least one piezoelectric element is of annular configuration including an opening therein which forms part of the axially-extending passage.

50. The improvement according to claim 49, wherein the driving means comprises two said piezoelectric elements, the electrode having an opening therethrough which forms part of the axially-extending passage and being interposed between the piezoelectric elements.

51. The improvement according to claim 50, wherein the diameter of the driving means is less than the diameter of the front and rear sections adjacent the driving means, and the means for clamping the front and rear sections comprises a plurality of fasteners connecting the front and rear sections and extending therebetween beyond the diameter of the driving means.

52. The improvement according to claim 51, and including a tubular sleeve extending about each of the piezoelectric elements.

53. The improvement according to claim 52, wherein the sleeves are of rubbery material.

54. The improvement according to claim 53, wherein the diameter of the piezoelectric elements is less than the diameter of the electrode and the outside diameter of the tubular sleeves is approximately equal to the diameter of the electrode.

55. The improvement according to claim 47, and including the tubular member which is secured to the front section.

56. The improvement according to claim 48 or 55, wherein the tubular member comprises a part of a liquid supply tube.

57. The improvement according to claim 48, and including a decoupling sleeve extending in the front section substantially from the atomizing surface to the threads in the axially-extending passage which receive the threaded portion of the tubular member.

58. The improvement according to claim 47 or 57, and including further means for securing the decoupling sleeve in the front section.

59. The improvement according to claim 55 or 57, wherein the decoupling sleeve and the tubular member constitute a single piece.

60. The improvement according to claim 59, wherein the decoupling sleeve and the tubular member are metal.

61. The improvement according to claim 59, wherein the single piece decoupling sleeve and the tubular member comprise part of a liquid supply tube.

62. The improvement according to claim 47 or 57, wherein the decoupling sleeve is metal.

63. The improvement according to claim 57, wherein the means for drawing comprise mating annular flange portions on the tubular member and in the rear section, the decoupling sleeve and tubular member constituting a single piece.

64. The improvement according to claim 63, wherein the securing means is disposed at or adjacent to a nodal plane.

65. The improvement according to claim 57, wherein the decoupling sleeve includes a threaded end section threadedly received in the threaded section of the axially-extending passage.

66. The improvement according to claim 65, wherein the output, front and rear sections, and the decoupling sleeve are of aluminum.

67. The improvement according to claim 48 or 55, wherein the tubular member includes an externally threaded section and the securing means comprises an internally threaded section in the axially-extending passage in the front section, the externally-threaded tubular member section being threadedly received in the internally-threaded section.

68. The improvement according to claim 48 or 55 and including means for insulating the electrode from the tubular member.

69. The improvement according to claim 48 or 55, wherein the tubular member comprises a sole support for mounting the transducer.

70. The improvement according to claim 48 or 55, wherein the tubular member extends exteriorly of the transducer and is adapted to be connected to a means for supplying liquid to the axially-extending passage.

71. The improvement according to claim 70, wherein the tubular member includes means adjacent to the transducer for connecting the tubular member to the means for supplying liquid.

72. The improvement according to claim 47 or 48, wherein the securing means is disposed at or adjacent to a nodal plane.

73. The improvement according to claim 47 or 57, wherein the output and the front and rear sections, and the decoupling sleeve are of metal material.

74. The improvement according to claim 57, wherein the decoupling sleeve and the tubular member constitute a single piece and the threaded portion of the tubular member is located adjacent to the decoupling sleeve.

75. The improvement according to claim 47 or 48, wherein the rear and front ultrasonic horn sections form a symmetrical double-dummy ultrasonic horn.

76. The improvement according to claim 48, wherein the means for drawing comprise mating annular flange portions on the tubualr member and in the rearsection.

77. The improvement according to claim 76, wherein the securing means is disposed at or adjacent to a nodal plane.

78. A transducer for atomizing liquids comprising an atomizing section having an atomizing surface, driving means disposed adjacent to the atomizing section, the atomizing section and the driving means having a passage axially extending therethrough to the atomizing surface, a decoupling sleeve in the axially-extending passage in the atomizing section with one end thereof extending substantially to the atomizing surface, the axially-extending passage being adapted to receive a tubular member through which liquid can be introduced into the transducer and delivered through the decoupling sleeve to the atomizing surface, means provided in or adjacent to the atomizing section adapted to secure the tubular member to the atomizing section with one end of the tubular member adjacent to the other end of the decoupling sleeve, and means cooperating with the atomizing section spaced radially outwardly from the axially-extending passage for coupling the driving means and the atomizing section to atomize liquid delivered to the atomizing surface through the tubular member and the decoupling sleeve in response to electrical excitation of the driving means.

79. A transducer for atomizing liquids comprising an atomizing section having an atomizing surface, driving means disposed adjacent to the atomizing section, a rear section disposed adjacent to the driving means which with the atomizing section sandwiches the driving means, the atomizing section, the driving means and the rear section having a passage axially extending therethrough to the atomizing surface, a tubular member having a threaded portion disposed in the axially-extending passage through which liquid can be introduced into the transducer and delivered to the atomizing surface, means provided in or adjacent to the atomizing section for securing the tubular member to the atomizing section comprising threads in the axially-extending passage which receive the threaded portion of the tubular member, means associated with the rear section and the tubular member for drawing the rear and the atomizer sections together upon threading the tubular member to the atomizing section, and means for coupling the driving means and the atomizing section to atomize liquid delivered to the atomizing surface through the tubular member in response to electrical excitation of the driving means.

80. The transducer according to claim 78 or 79, wherein the driving means comprises at least one piezoelectric driving element having an axially-extending opening therethrough which forms part of the axially-extending passage.

81. The transducer according to claim 80, wherein the driving means comprises two said piezoelectric driving elements, and an electrode having an opening therethrough which forms part of the axially-extending passage, the electrode being interposed between the piezoelectric driving elements.

82. The transducer according to claim 78 and including the tubular member which is secured to the atomizing section.

83. The transducer according to claim 79 or 82, wherein the tubular member comprises a part of a liquid supply tube.

84. The transducer according to claim 79 and including a decoupling sleeve extending in the atomizing section substantially from the atomizing surface to the threads in the axially-extending passage which receive the threaded portion of the tubular member.

85. The transducer according to claim 78 or 84 and including further means for securing the decoupling sleeve in the atomizing section.

86. The transducer according to claim 82 or 84, wherein the decoupling sleeve and the tubular member constitute a single piece.

87. The transducer according to claim 86, wherein the decoupling sleeve and the tubular member are metal.

88. The transducer according to claim 86, wherein the single piece decoupling sleeve and the tubular member comprise part of a liquid supply tube.

89. The transducer according to claim 78 or 84, wherein the decoupling sleeve is metal.

90. The transducer according to claim 79 or 82, wherein the tubular member includes an externally threaded section and the securing means comprises an internally threaded section in the axially-extending passage in the atomizing section, the externally-threaded tubular member section being threadedly received in the internally-threaded section.

91. The transducer according to claim 90 wherein the securing means is disposed at or adjacent to a nodal plane.

92. The transducer according to claim 82, wherein the decoupling sleeve and the tubular member constitute a single piece and wherein the transducer includes a rear section disposed adjacent to the driving means which with the atomizing section sandwiches the driving means, the axially-extending passage extending through the rear section, and means associated with the rear section and the single piece for drawing the rear and atomizing sections together upon securing the single piece to the atomizing section.

93. The transducer according to claim 92, wherein the means for drawing comprise mating annular flange portions on the tubular member and in the axially-extending passage in the rear section.

94. The transducer according to claim 79 or 82, wherein the tubular member comprises a sole support for mounting the transducer.

95. The transducer according to claim 79 or 82, wherein the driving means comprises an electrode having an opening which forms part of the axially-extending passage and including means for insulating the electrode from the tubular member.

96. The transducer according to claim 79 or 82, wherein the tubular member extends exteriorly of the transducer and is adapted to be connected to a means for supplying liquid to the axially-extending passage.

97. The transducer according to claim 96, wherein the tubular member includes means adjacent to the transducer for connecting the tubular member to the means for supplying liquid.

98. The transducer according to claim 78 and including the tubular member which is secured to the atomizing section, wherein the securing means includes threads disposed in the axially-extending passage in the atomizing section and the tubular member includes threads, the threaded securing means threadedly receiving the tubular member.

99. The transducer according to claim 78 or 79, wherein the securing means is disposed at or adjacent to a nodal plane.

100. The transducer according to claim 78 or 84, wherein the atomizing section and the decoupling sleeve are of metal material.

101. The transducer according to claim 100, wherein the atomizing section and the decoupling sleeve are of aluminum.

102. The transducer according to claim 84, wherein the decoupling sleeve and the tubular member constitute a single piece and the threaded portion of the tubular member is located adjacent to the decoupling sleeve.

103. The transducer according to claim 84, wherein the means for drawing comprise mating annular flange portions on the tubular member and in the axially-extending passage in the rear section, the decoupling sleeve and the tubular member constituting a single piece.

104. The transducer according to claim 103 wherein the securing means is disposed at or adjacent to a nodal plane.

105. The transducer according to claim 84, wherein the decoupling sleeve includes a threaded portion received in the threads in the axially-extended passage.

106. The transducer according to claim 78, wherein the decoupling sleeve includes a threaded end section and the axially-extending passage in the atomizing section includes a threaded section, the decoupling sleeve being threadedly received in the threaded section of the atomizing section.

107. The transducer according to claim 79, wherein said coupling means cooperate with the atomizing section and are spaced radially outwardly from the axially-extending passage.

108. The transducer according to claim 79, wherein the means for drawing comprise mating annular flange portions on the tubular member and in the axially-extending passage in the rear section.

109. The transducer according to claim 108 wherein the securing means is disposed at or adjacent to a nodal plane.

* * * * *